US005998749A

United States Patent [19]

Stockmaster et al.

[11] Patent Number: 5,998,749

[45] Date of Patent: Dec. 7, 1999

[54] SINGLE THROW PUMP SWITCH

[75] Inventors: David A. Stockmaster, Elizabethtown; Anthony E. Pierce, Glasgow, both of Ky.

[73] Assignee: E. M. B. Corporation, Elizabethtown, Ky.

[21] Appl. No.: 09/248,637

[22] Filed: Feb. 11, 1999

[51] Int. Cl.[6] ..... H01H 5/06

[52] U.S. Cl. ..... 200/457; 200/408

[58] Field of Search ..... 200/402, 405, 200/407–410, 424, 430–458, 462–472

[56] References Cited

U.S. PATENT DOCUMENTS

| | | | |
|---|---|---|---|
| 2,255,115 | 9/1941 | Helle | 200/67 |
| 2,262,397 | 11/1941 | Immel et al. | 200/122 |
| 2,291,019 | 7/1942 | Biermann et al. | 200/67 |
| 3,365,556 | 1/1968 | Flanagan | 200/67 |
| 4,230,919 | 10/1980 | Schantz et al. | 200/67 B |

*Primary Examiner*—Michael Friedhofer
*Attorney, Agent, or Firm*—Maurice L. Miller, Jr.

[57] ABSTRACT

A single pole, snap action, sump pump switch is disclosed having a housing containing a single electrically conductive contact arm with a contact mounted on a forward end portion, which arm is pivotally movable between on and off positions. The contact arm contains a pair of pivot tabs projecting from opposite sides on a rear end portion thereof, which pivot tabs fit within rearwardly opening, triangularly shaped notches on a U-shaped terminal. The notches form a fulcrum about which the contact arm rocks through the U-shaped member when switching between the on and off positions. An actuator arm is pivotally mounted between a pair of shoulders formed on opposing sidewalls within the housing and projects out of a rear end of the housing for connection to a float bulb assembly. A forward end of the actuator arm fits within a recess in one end of a pivot bushing. The other end of the bushing is open to receive one end of a coiled spring therein, the other end being compressed against a rear edge of the contact arm surrounding a centering tab. The actuator arm, bushing and spring combination, directly actuates the contact arm near the fulcrum, thus, providing a relatively long lever arm between the fulcrum and the contact to produce strong forces for moving the contact.

11 Claims, 3 Drawing Sheets

SINGLE THROW PUMP SWITCH

BACKGROUND OF THE INVENTION

This invention relates generally to electrical switches of the snap action type such as are connected for actuation to a float bulb to operate a sump pump. More specifically, this invention relates to a single pole, single throw, sump pump switch which uses a float bulb actuator arm to directly actuate a single electrically conductive switch contact arm to turn the switch on and off without the need for a rigid contact arm carrier or support structure.

Sump pump switches of the double pole, double throw type, which use a float bulb operated, pivotal actuator arm in combination with a pivot bushing and compression spring to actuate a support member carrying a pair of spaced apart electroconductive contact arms have long been known and used in the prior art. See, for example, U.S. Pat. No. 4,196,325 granted to S. A. Povilaitis on Apr. 1, 1980, and U.S. Pat. No. 4,916,274 granted to R. H. Hawley et al. on Apr. 10, 1990. All of the prior art sump pump switches known to us are of the double pole, double throw type and none are believed to be of the single pole, single throw type. A problem encountered when using these prior art sump pump switches as intended, is that the ground lead for the electrical service line to the sump pump is broken or interrupted when the hot lead is opened. While this may have been the usual practice in the past, it is clearly not good practice as the ground wire should never be broken or interrupted, even if only on a momentary basis. But if the ground lead is not to be broken, then there is no need for a double pole, double throw sump pump switch, at least insofar as 120 volt a.c. sump pumps are concerned.

Another difficulty encountered with prior art sump pump switches is that the movable electrical contact arms thereof are not directly actuated to move between their on and off positions by an actuator arm. Rather, the contact arms are carried by a rigid support and it is this rigid support that is moved by an actuator arm acting through a pivot bushing and compression spring, which support then moves the contact arms which are attached thereto. Certainly, where a single pole, single throw sump pump switch is concerned, we have found that there is no need for a rigid contact arm support or carrier and the single electrically conductive contact arm can be directly actuated by the actuator arm, pivot bushing and compression spring combination without the need for the support or carrier component.

Yet another difficulty encountered with prior art sump pump switches is that the carrier or support structure is operatively connected to the actuator arm, bushing and spring combination near or approximately on a transverse line extending between the two moving contacts of the contact arms so that there is virtually no lever arm, or, at most, only a very small one, between the pivot point of the carrier and the movable contacts on the contact arms. As a result, the force of engagement and disengagement of the movable contacts with a corresponding set of fixed contacts is relatively small.

By means of our invention, these and other difficulties encountered with prior art sump pump switches are substantially reduced or eliminated.

SUMMARY OF THE INVENTION

It is an object of our invention to provide a novel single throw, snap action switch of a type which may be used with a float bulb assembly to actuate a sump pump.

It is a further object of our invention to provide such a snap action switch having a single electrically conductive contact arm which is directly actuated to pivotally move, reciprocally, between two switch positions.

It is another object of our invention to provide a novel single throw, snap action switch having an electrically conductive contact arm which is pivotally mounted against one of two electrical terminals of the switch such that, when pivotally actuated to one of two switch positions, the contact arm electrically connects the two terminals together and disconnects them when pivotally actuated to the other of the two positions.

It is yet another object of our invention to provide a novel single throw, snap action switch having an electrically conductive contact arm which is actuated on a rear end portion thereof to pivot such that a first electrical contact mounted on a forward end portion thereof will move into an out of contact with a second fixed electrical contact of a terminal mounted in the housing with relatively great force due to the existence of a relatively long lever arm as measured along the contact arm between its pivot point and the first contact.

Briefly, in accordance with the objects of our invention, we provide a single throw, snap action switch comprising a housing and an elongated, electrically conductive contact arm pivotally mounted in the housing for reciprocal, pivotal movement between first and second switch positions. We also provide an elongated actuator arm pivotally mounted in the housing for reciprocal, pivotal movement between first and second actuator positions. A rear end portion of the actuator arm extends out of the housing for external, operative access thereto. We further provide a linkage assembly disposed in the housing between a forward end of the actuator arm and a rear end of the contact arm for causing a pivotal movement of the contact arm in either of two angular directions in response to a pivotal movement of the actuator arm in an opposite angular direction.

These and other objects, features and advantages of our invention will become apparent to those skilled in the art from the following detailed description and attached drawings, upon which, by way of example, only a preferred embodiment of our invention is illustrated.

DESCRIPTION OF THE PREFERRED EMBODIMENT

Figure 1:
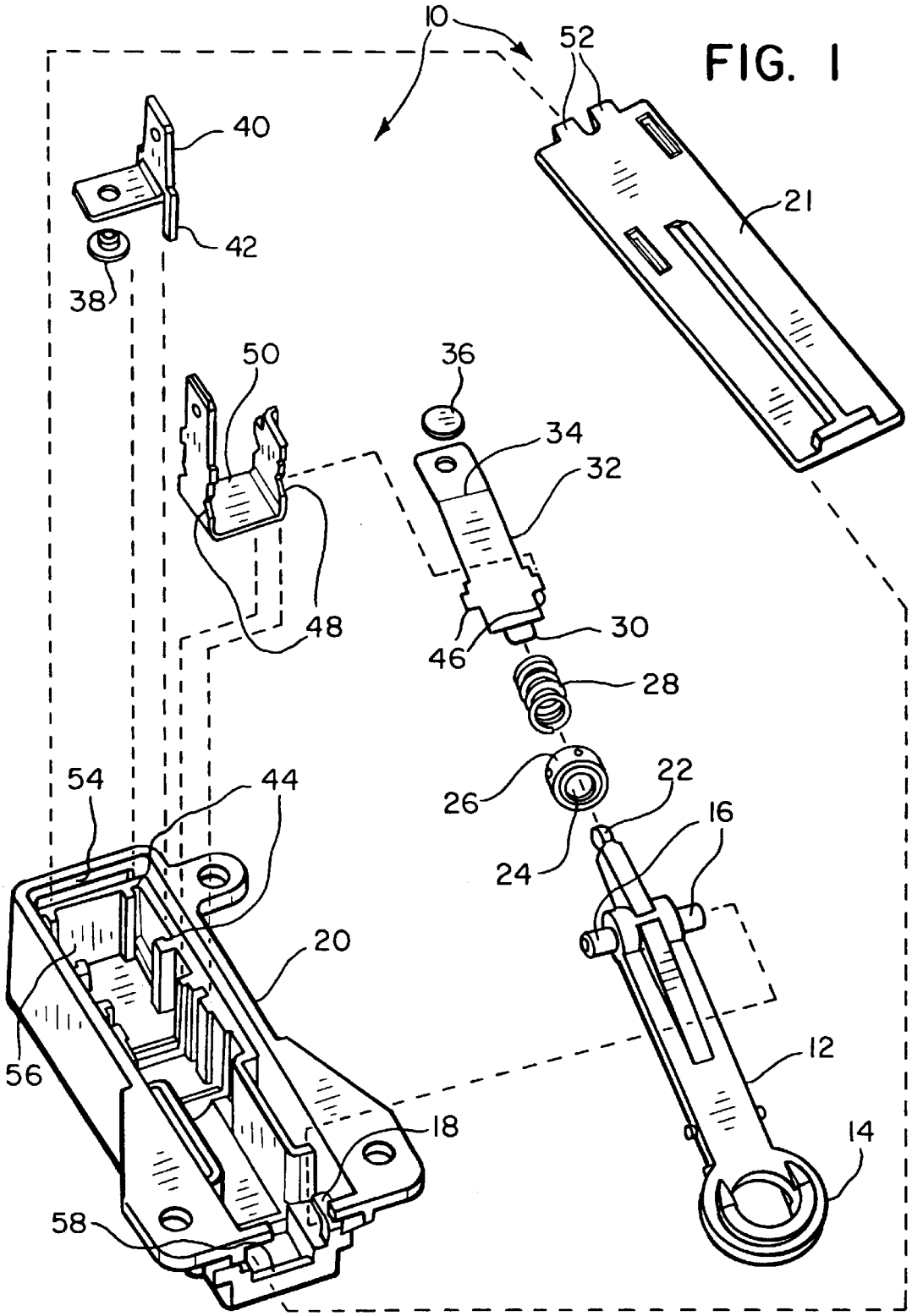
FIG. 1 shows an exploded perspective view of a single pole, single throw snap action switch for actuation of a sump pump, thus illustrating a preferred embodiment of our invention.

Referring now to the drawing figures, there is shown, in a preferred embodiment of our invention, single throw snap action switch, generally designated 10. While the switch 10 shown is of the single pole type, it could be of the double pole type if desired. The switch 10 includes a conventional actuator arm 12 having a hollow, annularly shaped rear end portion 14 adapted to fit over and upon the stem or shaft of a buoyant float bulb, not shown, of a sump pump in a usual and well known manner. The arm 12 contains conventional rocker pins 16 which pivotally fit within an opposing pair of shoulders 18 projecting from opposite rear interior surfaces of a plastic, preferably electrically insulative switch housing 20.

Figure 2:
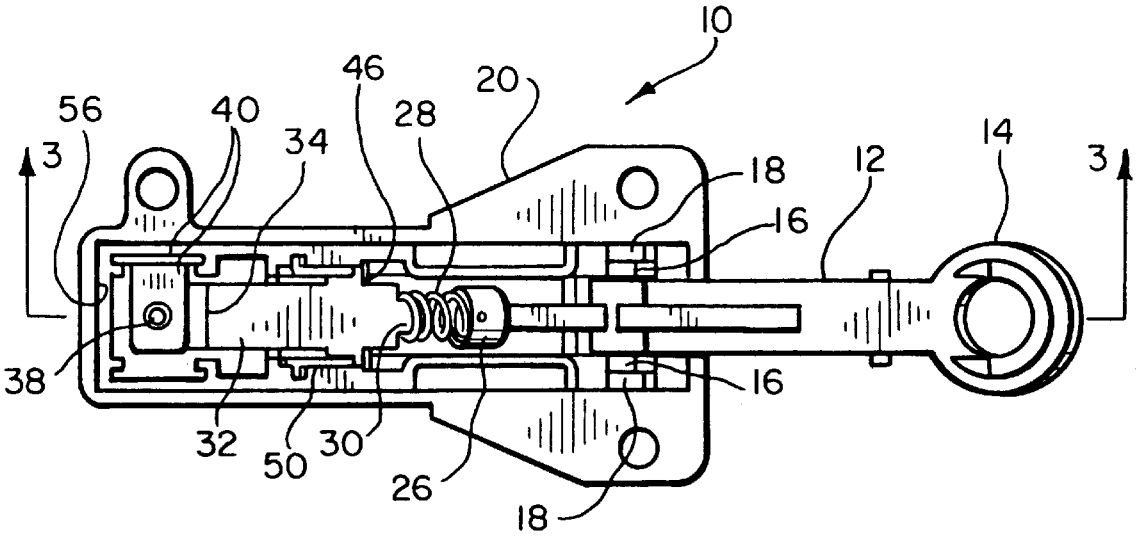
FIG. 2 shows a bottom plan view of the assembled switch of FIG. 1 with housing cover removed.
Figure 3:
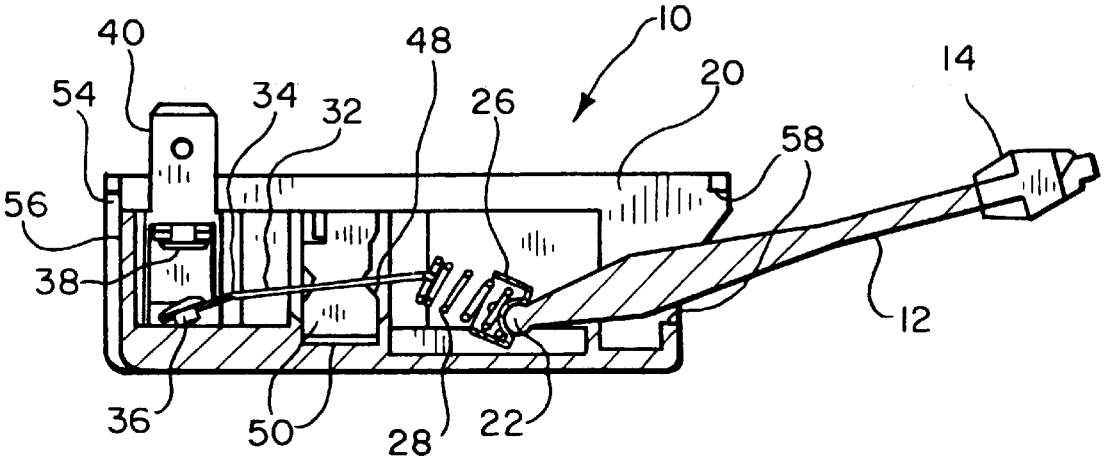
FIG. 3 shows a cross-sectional elevation view of the switch of FIGS. 1–2 as viewed along cross-section lines 3—3 of FIG. 2, the switch being shown in an open position or OFF position.
Figure 4:
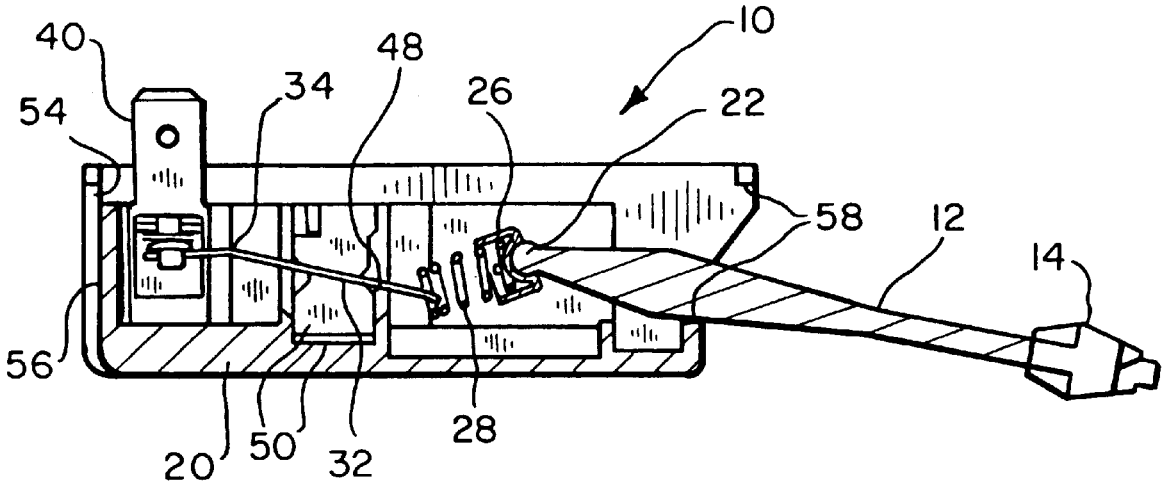
FIG. 4 shows a cross-sectional elevation view of the switch of FIGS. 1–3, the same as viewed in FIG. 3 except that, in this view, the switch is shown in a closed or ON position.

The housing 20 defines a hollow interior and an open bottom side in which certain of the switch components are recessed and includes a bottom cover 21 which can be snap fit thereon in a conventional manner. A rounded forward end portion 22 of the actuator arm 12 fits within a rounded depression or recess 24 in one end of a pivot bushing 26. An opposite end of the bushing 26 is open so that one end portion of a coiled spring 28 can fit therein as best seen in FIGS. 2–4. An opposite end of the spring 28 is compressed against a rear edge of a relatively thin, electrically conductive metal, switch contact arm 32 and encircles a coil centering tab 30 projecting from the rear edge of the arm.

The contact arm 32 contains a slight bend near a forward end thereof, as seen best in FIGS. 3–4 and as represented in the drawing figures by a bend line 34. The resulting bent forward end portion of the contact arm 32 permits a conventional disc shaped contact 36 mounted thereon to make a more solid, flush contact with a similarly shaped contact 38 mounted on a base portion of an electrical terminal 40 disposed in the housing 20 which is externally accessible, electrically, relative to the housing 20. The terminal 40 contains a pair of spaced apart legs 42 (only one of which is shown in FIG. 1) which are removably inserted into guide slots 44 molded onto a forward end portion of an interior sidewall of the housing 20. The contact arm 32 contains a pair of oppositely disposed, outwardly projecting tabs 46 on side edges of a rear end portion thereof, which tabs fit into a pair of triangularly shaped, rearwardly opening notches 48 (See FIGS. 1 and 3–4) formed in rear edge portions of a contact arm support terminal 50. The notches 48 constitute a fulcrum about which the contact arm 32 reciprocally pivots against the terminal 50 when actuated between first and second switch positions.

A central portion of oppositely facing interior sidewalls of the housing 20 is molded to form guides for confining the terminal 50 securely therein, all in a well known manner. The cover 21 includes a pair of tabs 52 (See FIG. 1) projecting forwardly from a forward end thereof, which tabs insert through an elongated opening 54 formed in a front wall of the housing 20 which extends over and transversely across a front panel 56. A rear end of the housing 20, is open, as at 58, so that a rear end portion of the actuator arm 12 can project out of the back of the housing for external, operative access thereto, as, for example, by connection of the end portion 14 to a float bulb shaft as previously mentioned. The vertical depth of the opening 58, as viewed in FIGS. 3–4, must be sufficient to permit the actuator arm 12 to move between its position as shown in FIG. 3, wherein the contact arm 32 is pivoted to an open or off position out of contact with the contact 38, and its closed or on position as shown in FIG. 4, wherein the contact 36 of the arm 32 engages the contact 38. The actuator arm 12 and the cover 21 should also be made of an electrically insulative material, preferrably plastic. Notice that there is no need for the cover 21 to be fastened in position on the bottom of the housing 20 by means of a threaded fastener, since the combination of the actuator arm 12 and a linkage assembly, including the pivot bushing 26 and compression spring 28, and contact arm 32 do not require the cover 21 to be inserted in position on the housing in order to hold them in an operative assembly as shown in FIGS. 2–4. Indeed, these four components never bear against the cover 21 in either of their two stable states as shown in FIGS. 3–4.

The spring 28 is held in compression in the pivot bushing 26 against a rear edge of the contact arm 32 by the rounded forward end 22 of the actuator arm 12, regardless of whether the contact arm and actuator arm are in the on or closed switch position or in the off or open switch position. While this snap action arrangement of the pivot bushing 26 and spring 28 is old and well known in the art when used to actuate an electrically insulated contact arm bridge support which, in turn, carries a pair of spaced apart, electrically conductive contact arms, the use of such an arrangement, as here, to directly snap an electrically conductive contact arm is believed to be novel. But, in the prior art, a pivotal actuator arm is used to engage a pivot bushing and spring to, in turn, actuate the bridge support on a forward end thereof, which forward end is in transverse alignment with the electrical contact containing ends of the contact bridges or contact arms carried by the support. By contrast, in the present example of our invention, the pivot bushing 26 and spring 28 combination not only fit directly to a single electrically conductive contact bridge or arm 48, without use of a support or carrier, but actually fit against a rear edge of the contact arm 32 near and just rearwardly of the notch or contact arm pivot point 48. See FIGS. 2–4. This arrangement provides a relatively strong contact force at a forward end of the contact arm 32 to engage and disengage the contact 36 with and from the contact 38, due to the existence of a relatively long lever arm, as measured from the notch 48 to the contact 36. On the other hand, with regard to the snap action of the subject prior art dpdt switch, there is relatively little if any corresponding lever arm. Accordingly, the relatively strong force and/or relatively longer lever arm of engagement and disengagement of the contacts of our switch is a distinct advantage over the weaker force and/or shorter lever arm of snap action switches of the prior art. Lastly, because the contact arm 32 is not carried on a rigid support, a forward end portion of the contact arm can be bent, as along bend line 34, to permit the contact 36 to engage flush against the contact 38 as the contact arm is pivoted through an arc from the off to the on position.

Although the present invention has been described and illustrated with respect to specific details of a certain preferred embodiment thereof, it is not intended that such details limit the scope and coverage of this patent other than as is specifically set forth in the following claims.

We claim:

1. A single throw, snap action switch comprising a housing;

an elongated, electrically conductive contact arm having a forward end and a rear end and being pivotally mounted in said housing for reciprocal, pivotal movement such that said forward end is movable between spaced apart first and second switch positions, a fulcrum of said pivotal movement being positioned adjacent opposite sides of said contact arm an a pivot axis which is perpendicular to the length of said contact arm and which is spaced from and positioned between said forward end and said rear end;

an elongated actuator arm having a forward end and a rear end and being pivotally mounted in said housing for reciprocal, pivotal movement such that said actuator arm forward end is movable between spaced apart upper and lower actuator positions, a rear end portion of said actuator arm extending out of said housing for external, operative access thereto; and a linkage assembly disposed in said housing between said forward end of said actuator arm and said rear end of said contact arm for causing said pivotal movement of said contact arm in response to a pivotal movement of said actuator arm.

2. The snap action switch of claim 1 further comprising a first, U-shaped electrical terminal mounted in said housing and having a pair of spaced apart legs through which said contact arm extends, said contact arm being pivotally fitted against said legs, said first terminal having one of said legs extending out of said housing for external electrical access thereto.

3. The snap action switch of claim 2 wherein each of said legs defines a notch on a rear edge thereof, said contact arm including a pair of pivot tabs extending from opposite side edges of a rear end portion of said contact arm into said notches such that said notches, together, form said fulcrum for the reciprocal, pivotal movement of said contact arm.

4. The snap action switch of claim 1 further comprising a second electrical terminal mounted in said housing and extending out of said housing for external electrical access thereto, said second terminal containing a first, fixed electrical contact, a forward end portion of said contact arm containing a second contact which is movable therewith and which is aligned for engagement with said first contact when said contact arm is disposed in one of said switch positions, said first contact and said second contact being electrically separated when said contact arm is in the other of said switch positions.

5. The snap action switch of claim 3 wherein said second terminal includes a leg which extends out of said housing for external electrical access to said first contact.

6. The snap action switch of claim 4 wherein said forward end portion of said contact arm is bent at an angle relative to a remaining portion of said contact arm such that said first contact and said second contact engage flush with one another when said contact arm is disposed in said one of said switch positions.

7. The snap action switch of claim 1 wherein said linkage assembly comprises a pivot bushing having a rounded recess in a rear end thereof into which a forward end of said actuator arm extends and an open forward end; and a coiled spring partially disposed in said bushing through said open forward end and extending forwardly out of said bushing into compression against a rear end of said contact arm, said contact arm also including a coil centering tab extending from the rear end thereof which is surrounded by said spring.

8. The snap action switch of claim 7 wherein said actuator arm is disposed and moves in a plane in which said contact arm is disposed and moves.

9. The snap action switch of claim 1 wherein said contact arm comprises a relatively thin, generally rectangularly shaped member, said member including a pair of relatively thin, rectangularly shaped pivot tabs extending outwardly from opposite side edges of said member, said pivot tabs also being aligned with one another, for connection to said fulcrum.

10. The snap action switch of claim 1 wherein said linkage assembly is arranged such that said rear end of said contact arm moves to a raised position when said forward end of said actuator arm moves to said lower position and moves to a lowered position when said forward end of said actuator arm moves to said upper position.

11. A single throw, snap action switch comprising a housing;

a single, elongated, relatively flat, electrically conductive contact arm pivotally disposed in said housing and including a pair of pivot tabs extending from opposite side edges on a rear end portion thereof, said contact arm being reciprocally, pivotally movable between a first and a second switch position;

an elongated actuator arm pivotally mounted in said housing between opposing rear interior sidewalls of said housing, said actuator arm being disposed behind said contact arm, a rear end portion of said actuator arm extending out of said housing for external, operative access thereto;

a linkage assembly disposed in said housing between said actuator arm and a rear edge of said contact arm for causing pivotal movement of a forward end of said contact arm in response to a pivotal movement of said actuator arm, the pivotal movements of both said contact arm and said actuator arm being in a single plane;

a first, U-shaped, electrical terminal mounted in said housing and having a pair of spaced apart legs through which said contact arm extends, each of said legs containing a rearwardly opening notch therein which, together, form a fulcrum for the pivotal movement of said contact arm, each of said pivot tabs extending into and across a different one of said notches and bearing against a different one of said legs, one of said legs extending out of said housing for external electrical access thereto; and a second electrical terminal mounted in said housing forwardly of said first terminal and having a portion extending out of said housing for external electrical access thereto, said second electrical terminal containing a first electrical contact, a forward end portion of said contact arm containing a second electrical contact aligned for engagement with said first contact when said contact arm is disposed in said first switch position and for disengagement with said first contact when said contact arm is disposed in said second switch position.

* * * * *